United States Patent [19]

Chulay

[11] 4,102,490

[45] Jul. 25, 1978

[54] DATA RING FOR VERTICAL TUBE ROTOR

[75] Inventor: Steven John Chulay, Los Altos, Calif.

[73] Assignee: Beckman Instruments, Inc., Fullerton, Calif.

[21] Appl. No.: 803,818

[22] Filed: Jun. 6, 1977

[51] Int. Cl.[2] ..... B04B 5/04

[52] U.S. Cl. ..... 233/26

[58] Field of Search ..... 233/26, 1 R, 27; 23/259

[56] References Cited

U.S. PATENT DOCUMENTS

| | | | |
|---|---|---|---|
| 3,248,046 | 4/1966 | Feltman et al. | 233/26 |
| 3,441,383 | 4/1969 | Moore et al. | 23/259 X |
| 4,010,893 | 3/1977 | Smith et al. | 233/26 X |

*Primary Examiner*—George H. Krizmanich

*Attorney, Agent, or Firm*—Robert J. Steinmeyer; Ferd L. Mehlhoff; William H. May

[57] ABSTRACT

An identification means placed adjacent the test tube cavities in a centrifuge rotor. The identification means utilizes recessed or indented indicia which are positioned on a circular ring raised above the generally flat top surface of the rotor. The identification indicia are used for identifying or labeling each of the test tube cavities in the rotor. The raised nature of the ring eliminates the possible establishment of weak points or areas in the top surface of the rotor during centrifugation.

6 Claims, 3 Drawing Figures

DATA RING FOR VERTICAL TUBE ROTOR

BACKGROUND OF THE INVENTION

The present invention is directed to identification means for tube cavities in rotors and, more particularly, is directed to an identification means used on vertical tube rotors. Such identification, usually accomplished by numbering the cavities, permits a rotor user to distinguish between the several tubes which are being centrifuged.

In prior art type rotors, such as the fixed angle type rotor, the identification number for each of the rotor cavities is placed on the inner or centripetal side of the counterbore area above the tube cap. In some cases the labeling number is stamped onto the top surface of the rotor closely adjacent the centripetal side of the counterbore area of each of the cavities. Since the rotor cavity is not completely filled by the tube and cap assembly, and since the top portion of the fixed angle rotor is relatively small, no great amount of stress is placed on the top surface of the rotor where the number is located.

The usual procedure for placement of numbers has been to stamp the labeling number or letter for each cavity into the actual surface or body of the rotor. This procedure, however, presents some concern, since, if the stamping or indenting into the body of the rotor itself is done where significant stress or forces are exerted on the rotor during centrifugation, the formation of a stress crack could occur which may propagate into the rotor body. The tremendous loading during centrifugation accentuates any possible weak points which may be caused by the stamping of an indentation into the rotor body.

In other prior art approaches a paper template of some type or possibly a thin sheet of metal has been affixed to the top surface of the rotor adjacent the cavities for identification purposes. However, because of the high centrifugation forces which are exerted during the rotation of the rotor, there is an extreme likelihood that the template may break and pull off of the rotor body, resulting in possible damage to the rotor and centrifuge.

The problem of properly identifying the rotor test tube cavities without inducing possible weak points within a highly stressed region becomes a very significant problem with respect to the generally cylindrical vertical tube rotor, having an extremely high stress area across its entire top surface. Consequently, the indentation in this top surface with identification numbers may cause weak points where, during the centrifugation, cracking could occur leading to eventual failure of the rotor body. Each of the cavities in a vertical tube rotor is capped with a metal plug. The centrifugal weight of each plug contributes significantly to the stresses in the top surface of the rotor. This top surface is one of the most highly stressed regions of the rotor during centrifugation. Therefore, much concern exists as to the possibility of causing potential cracking in the rotor during high speed centrifugation as a result of placement of indented or engraved labeling adjacent the cavities in the rotor.

SUMMARY OF THE INVENTION

The present invention comprises an identification means which is integrally formed within the rotor body and is slightly raised above the top surface of the rotor body, so that the high stress field developed during high speed centrifugation adjacent to this raised circular data ring is not accentuated by the presence of indented or engraved indicia.

The data ring is formed by machining the upper surface of the rotor, so that this raised portion is an integral part of the rotor body. The indented identification marks are raised above the high stress field which exists at the top surface of the spinning rotor body. The centrifugal loading by the mass of the data ring itself makes only a very small contribution to the rotor stresses during centrifugation, because it is relatively small compared to the mass of the entire upper portion of the rotor.

DETAILED DESCRIPTION OF THE INVENTION

Figure 1:
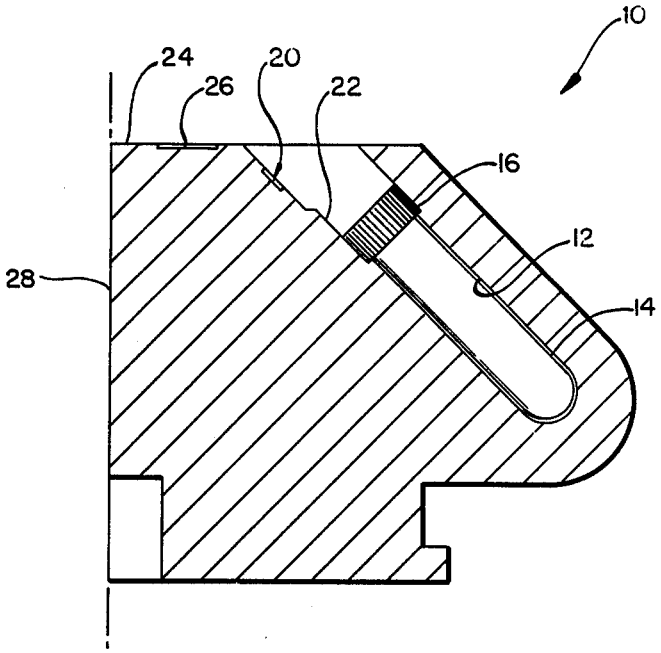
FIG. 1 is a sectional view of a fixed angle rotor showing prior art labeling or identification.

With respect to FIG. 1 a fixed angle rotor 10 is shown having a tube cavity 12 containing a test tube 14 with its tube cap 16. Since a plurality of tube cavities 12 is situated along the periphery of the rotor 10, it is necessary for the operator of the rotor to have each of these cavities labeled in some way, so that he may maintain a record of which sample is placed in which of the cavities. Typically, fixed angle rotors, as shown in FIG. 1, have an indented or engraved identification number 20 on the centripetal wall 22 of the cavity. At this location there is relatively little stress placed on the indentation, since it is located on a side wall which is not experiencing high forces exerted on it during centrifugation. As an alternative, the identification number may be stamped on the top surface 24 of the rotor at the location 26. Because the cap 16 is recessed downward in that cavity, little stress is placed on the indentation location 26.

It should be noted that during centrifugation the magnitude of stress placed upon a region of the rotor is largely determined by the amount of mass on the centrifugal side of that region of the rotor in a plane perpendicular to the spin axis. In the case of the fixed angle rotor 10 in FIG. 1 with the recessed cap 16, the loads inserted in the rotor cavities contribute very little to the stresses in the vicinity of the identification marks 26 or 22.

Figure 2:
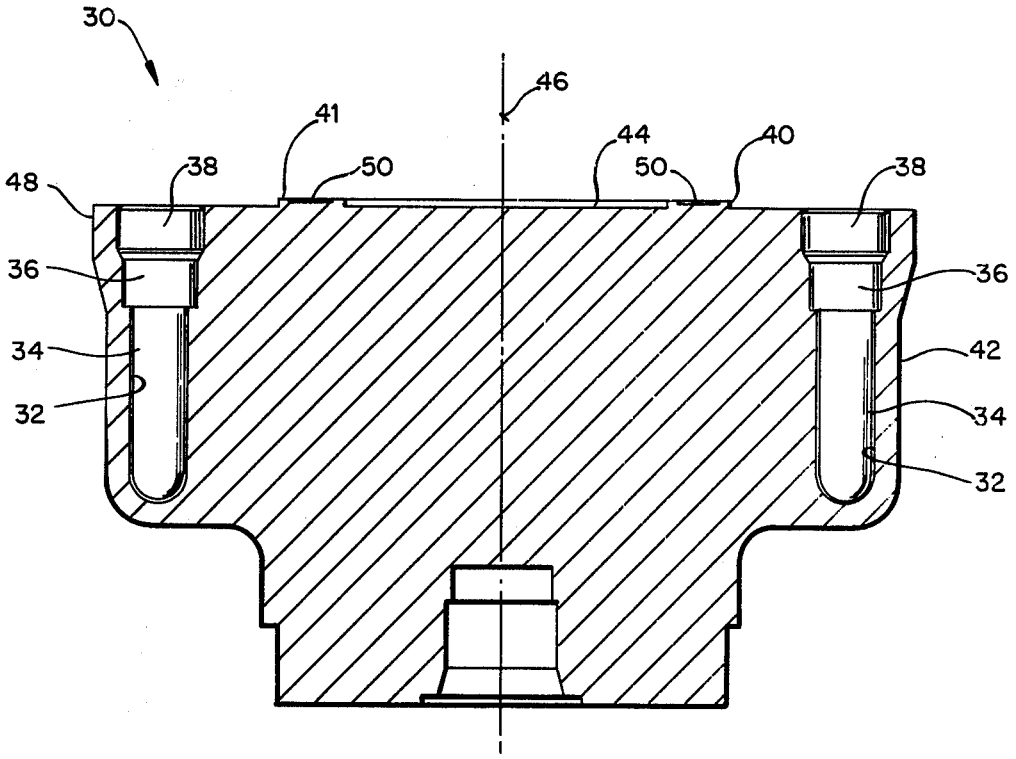
FIG. 2 is a sectional view of a vertical tube rotor showing the identification ring of the present invention.
Figure 3:
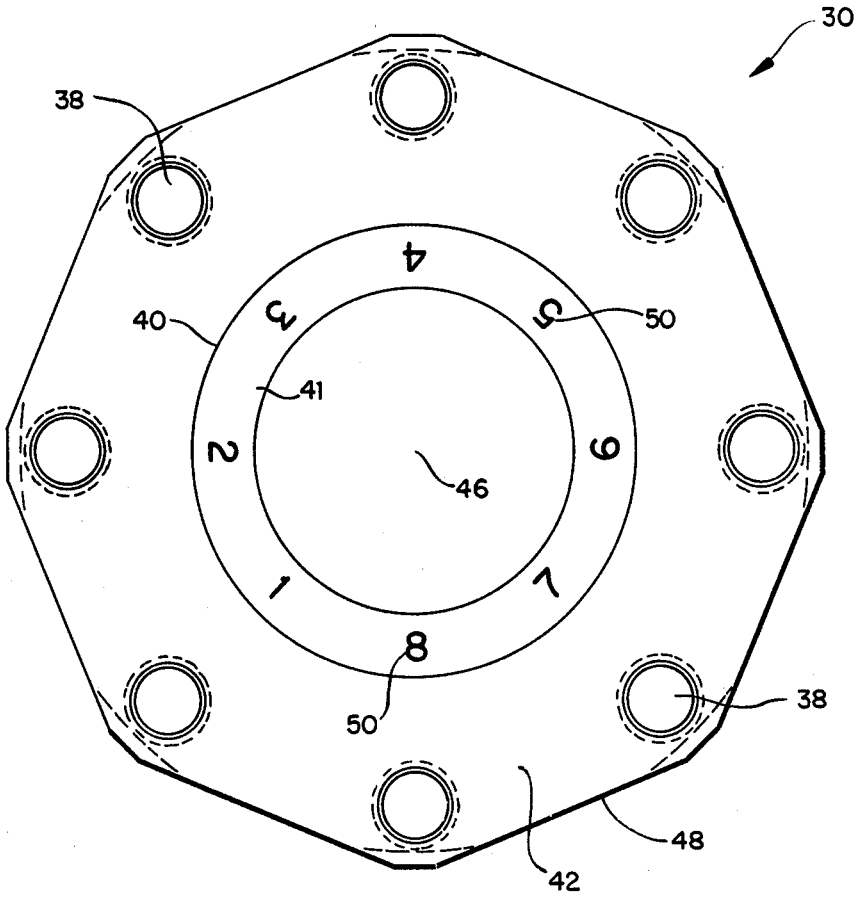
FIG. 3 is a top view of the vertical tube rotor as shown in FIG. 2 disclosing the orientation of the data ring with respect to the plurality of tube cavities.

Attention is directed to FIG. 2, showing a vertical tube rotor 30, having a plurality of tube cavities 32 containing test tubes 34 on which are mounted tube caps 36. Also threadably engaged within the rotor above the tube cap are tube cavity plugs 38 which retain the caps 36 and tubes 34 within the cavities 32 during centrifugation. As stated previously with respect to the fixed angle rotor 10 in FIG. 1, it is important that the operator of the rotor have some kind of indicating means on the tube cavities 32 for the purpose of labeling the location of each test tube 34 containing different samples. As shown in FIG. 3, there may be as many as eight different tube cavities 32 located along the periphery of the rotor 30.

Furthermore, inherent in the design of a vertical tube rotor as compared to a similarly sized or rated fixed angle rotor is the fact that there is more mass at the top surface of the vertical tube rotor. In a fixed angle rotor the top portion of the rotor is narrower than its lower portion. Consequently, the generally cylindrical vertical tube rotor has a greater mass at its top surface as compared to a fixed angle rotor which contributes significantly to the stress on the top surface of the vertical tube rotor.

The design and configuration of the vertical tube rotor with its metal plug 38 located over each of the test tube cavities 32 creates a critical stress area along the top surface of the spinning rotor. Therefore, the presence of the metal plugs adds significantly to the stresses along the top portion 44 of the rotor during centrifugation.

The present invention is directed to the utilization of a data ring 40 which is located adjacent to the tube cavities 32 in the rotor. This data ring is formed through a machining process on the rotor body 42 wherein the top surface 44 of the rotor body is machined down and the data ring 40 is left as a raised annular ring on the top surface 44 and centered on the spin axis 46. Consequently, this data ring 40 is formed integrally with the rotor body 42.

The utilization of the raised data ring 40 with the engraved indicia 50 above the top surface 44 of the rotor body eliminates the possibility of any cracking occurring adjacent to the engraved markings. The data ring 40 itself is not subjected to high stresses, because its self-loading is small and its salient geometry places it beyond the high stress field experienced by the top surface 44 of the rotor body.

Reference is made to FIG. 3 showing the general positioning of the data ring 40 adjacent the plurality of rotor test tube cavities 32 around the rotor body. The data ring 40 is a symmetrical circle centered on the spin axis 46, so that the balance of the rotor is maintained.

Although the vertical tube rotor shown in FIGS. 2 and 3 has a flat top surface 44, it is envisioned that possibly the top surface 44 could be sligthly conical projecting surface and still could utilize a raised data ring similar to the data ring 40 in FIGS. 2 and 3.

The general circular shape of the data ring 40 in FIGS. 2 and 3 should be sufficiently wide to contain the information to be marked on the rotor. Further, the data ring should have a generous radius with respect to the rotational axis of the rotor and minimize the stress concentration associated with any sudden change in the shape of the rotor which is a stressed body during centrifugation.

What is claimed is:

1. A centrifuge rotor comprising:

a rotor body;

a plurality of tube apertures symmetrically arrayed in a circular pattern within said rotor body; and means integrally formed with and positioned above the upper surface of said rotor for identifying each of said apertures, said identifying means and said rotor body being formed from one integral member, said upper surface being coincident with a high stress field in said rotor during centrifugation, said identifying means being outside of said high stress field to eliminate potential weak areas in said upper surface of said rotor during centrifugation.

2. A centrifuge rotor as defined in claim 1 wherein said identifying means comprises a data ring located on the top surface of said rotor.

3. A centrifuge as defined in claim 2 wherein said data ring is raised above said top surface of said rotor.

4. A centrifuge rotor as defined in claim 2 wherein said ring has indicia indented within said ring.

5. A centrifuge rotor as defined in claim 4 wherein said indicia are indented within said ring no greater than one half the height or depth of said data ring.

6. A centrifuge rotor comprising:

a rotor body;

a plurality of tube cavities within said rotor body;

a data ring located on the top surface of said rotor body adjacent said plurality of tube cavities; and indicia placed on said data ring to identify said tube cavities, said data ring being integrally formed with said rotor body and said data ring being raised above said top surface of said rotor, so that said indicia are above said top surface of said rotor body to eliminate potential weak areas in said top surface of said rotor during centrifugation.

* * * * *